US005190495A

United States Patent [19]

Taxon

[11] Patent Number: 5,190,495

[45] Date of Patent: Mar. 2, 1993

[54] HIGH CAPACITY COIN HOPPER FOR A GAMING MACHINE

[75] Inventor: Thomas N. Taxon, Henderson, Nev.

[73] Assignee: Bally Manufacturing Corporation, Chicago, Ill.

[21] Appl. No.: 655,871

[22] Filed: Feb. 14, 1991

[51] Int. Cl.[5] ..... G07D 9/04

[52] U.S. Cl. ..... 453/32; 453/57; 221/200

[58] Field of Search ..... 453/29, 30, 32-35, 453/57; 221/182, 183, 200, 237

[56] References Cited

U.S. PATENT DOCUMENTS

| | | | |
|---|---|---|---|
| 1,912,248 | 5/1933 | Bateman et al. | 221/237 |
| 2,332,026 | 10/1943 | Suppiger | 221/237 X |
| 3,680,566 | 8/1972 | Tanaka et al. . | |
| 3,703,903 | 11/1972 | Lardis et al. | 453/57 |
| 3,707,244 | 12/1972 | Hull et al. | 453/31 X |
| 3,902,511 | 9/1975 | Jacobs . | |
| 3,912,123 | 10/1975 | Seragnoli | 221/237 |
| 3,942,542 | 3/1976 | Erickson . | |
| 3,942,544 | 3/1976 | Breitenstein et al. . | |
| 4,148,331 | 4/1979 | Nicolaus . | |
| 4,275,751 | 1/1981 | Bergman . | |
| 4,316,553 | 2/1982 | Persson | 221/182 X |
| 4,574,824 | 3/1986 | Paulsen et al. . | |
| 4,589,433 | 5/1986 | Abe . | |
| 4,798,558 | 1/1989 | Bellis | 453/57 X |
| 4,881,919 | 11/1989 | Dabrowski | 453/57 |
| 4,902,263 | 2/1990 | Ito et al. | 453/57 X |
| 5,040,657 | 8/1991 | Gunn et al. | 453/3 X |
| 5,114,381 | 5/1992 | Ueda et al. | 453/57 |
| 5,122,094 | 6/1992 | Abe | 453/57 |

FOREIGN PATENT DOCUMENTS

| | | | |
|---|---|---|---|
| 2359466 | 2/1978 | France . | |
| 1559741 | 1/1980 | United Kingdom . | |
| 1599145 | 9/1981 | United Kingdom . | |
| 2203582 | 10/1988 | United Kingdom | 453/33 |

*Primary Examiner*—Michael S. Huppert
*Assistant Examiner*—William M. Hienz
*Attorney, Agent, or Firm*—Jenner & Block

[57] ABSTRACT

A high capacity coin hopper is disclosed comprising a cylinder mounted for rotation above a coin dispensing disc assembly. The central axis of the cylinder is offset above the central axis of the coin dispensing disc, creating a wall in the cylinder. Coins pile up against the wall, alleviating pressure and jamming in the region of the disc. Coins spill over the wall where they are picked up by the disc. In addition, lift fingers inside the cylinder pick up coins from the base of the wall and lift them above the wall so they can fall into the region of the disc.

27 Claims, 4 Drawing Sheets

HIGH CAPACITY COIN HOPPER FOR A GAMING MACHINE

BACKGROUND OF THE INVENTION

1. Field of the Invention

The present invention relates to a method and mechanism for storing and dispensing coins or tokens in a gaming machine, and more particularly relates to a method and mechanism for storing, agitating and dispensing a large volume of larger-diameter tokens in a gaming machine .

2. Background of the Invention

U.S. Pat. No. 3,942,544, and No. 4,148,331 are illustrative of gaming machine coin handling mechanisms. These references disclose an apparatus comprising a hopper for holding a supply of coins, an inclined rotary disc having coin-receiving pockets, and an arcuate trough or gutter at the foot of the hopper through which the lower portion of the disc rotates and into which the coins gravitate and tumble to lodge in the pockets, by which they are lifted to a higher level to be counted and dispensed. Maximum operating efficiency is achieved when all of the pockets are occupied by coins in each cycle of revolution of the disc and the disc is rotated at an optimal speed consistent with the ability of the coins to work into the pockets as a result of the random movements of the coins jostling against the face of the disc.

An inherent problem with such a system is the tendency of the coins to jam. This tendency increases as the volume of the hopper and the size (diameter) of the coins increase, and is a particular problem with large coins such as the $5 tokens commonly used in gaming machines. The problem is compounded by the fact that larger coins require a larger hopper to store the same quantity of coins.

In the operation of the machines known in the art, there is an inherent tendency of the accumulated coins in the hopper to be dragged along by the lower portion of the disc in the direction of rotation and to pile up in the corner of the hopper from which the disc begins to rise. There is a further tendency for this pile of coins to build up reversely back across the hopper toward the opposite or disc reentry corner and thus create a barrier across the gutter blocking entry of coins into the gutter. As a result, the disc may rotate for periods without picking up any coins.

U.S. Pat. No. 4,148,331 and No. 4,574,824 disclose an agitating method and means using an agitator mounted centrally on the coin dispensing disc to stir the coins. This improvement somewhat reduces, but does not eliminate, the blocking decribed above, and by itself is ineffective, particularly with larger diameter coins and larger size hoppers. Further, the agitating/mixing function is integral with the dispensing function, since the agitator turns only when the coin dispensing disc is turning. If the coin dispensing disc becomes jammed, there is no convenient way to agitate the coins to break up the jam.

SUMMARY OF THE INVENTION

It is therefore an object of the invention to provide a high-capacity coin hopper with an improved dispensing efficiency for all size coins, including those of larger diameter. It is a further object of the invention to provide a method and means to substantially eliminate the described jamming and blocking problems. It is a further object of the invention to provide separate agitation/mixing and dispensing functions.

DETAILED DESCRIPTION OF A PREFERRED EMBODIMENT

Figure 1:
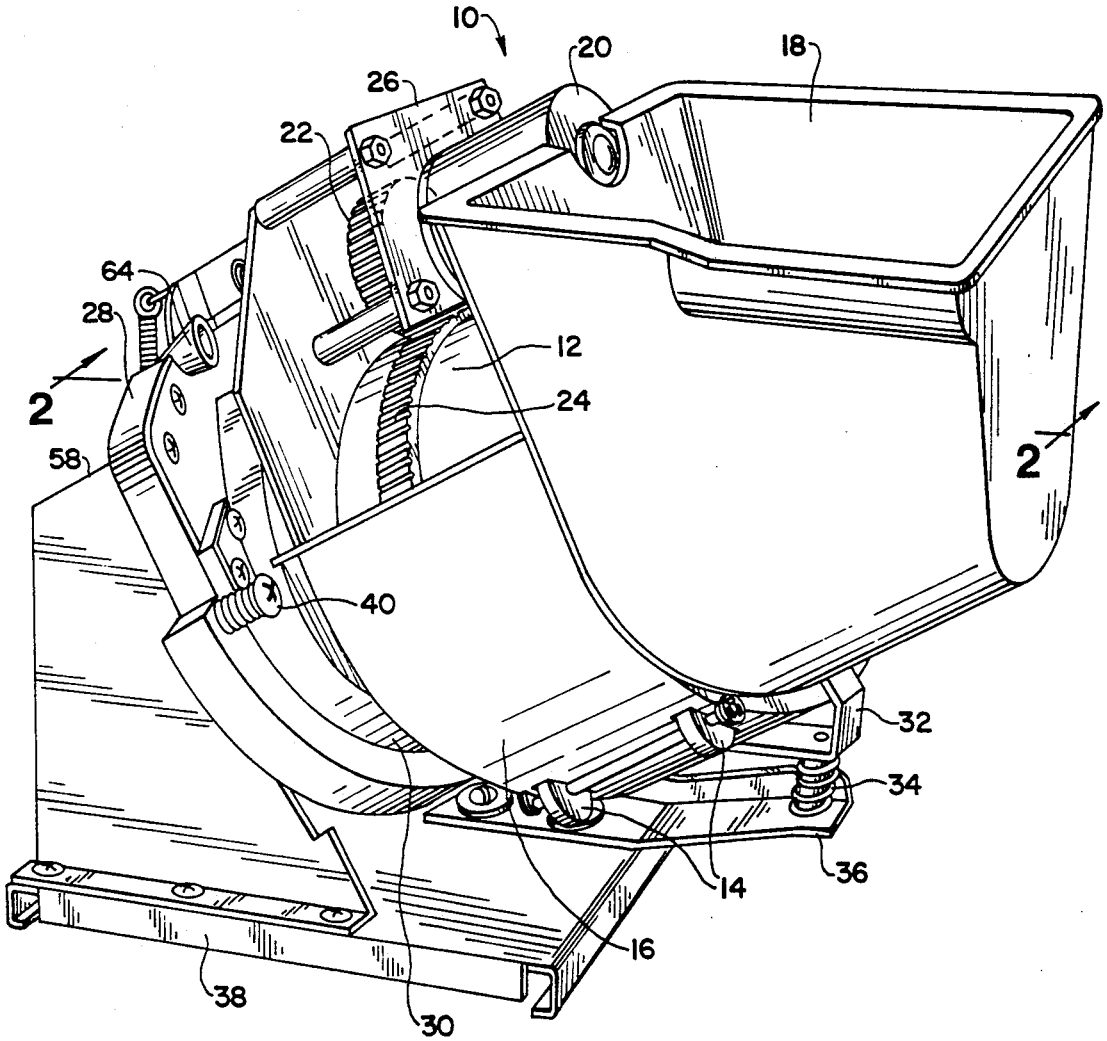
FIG. 1 is a perspective view of the coin hopper according to the invention.

As shown in FIG. 1, a coin hopper 10 includes a cylinder 12 mounted for rotation on rollers 14 in a cylinder mounting bracket 16. A coin bowl 18 is mounted on the bracket 16 above the cylinder 12. The cylinder 12 is rotated by a cylinder drive motor 20 by way of the gear 22 which engages teeth 24 on the exterior of the cylinder 12. The cylinder drive motor 20 is supported by a motor bracket 26. In an alternative embodiment, the cylinder 12 may be rotated by a belt passing around the cylinder 12 and around a pulley mounted to the shaft of the motor 20. Although the exact dimensions of the cylinder 12 are not critical and not related to coin diameter, a cylinder 12 with an outside diameter of 7 inches accommodates coins up to at least 1.875 inches in diameter and allows the coin hopper 10 to fit inside the cabinets of conventional gaming machines. A coin transport disc assembly 28 is located at the lower end of a mount adapter 30.

The coin bowl 18 is additionally supported in the preferred embodiment by a coin bowl bracket 32 which rests on a spring 34, which in turn rests on a bracket 36, which extends from a base 38. The entire hopper 10 is attached to the coin transport disc assembly 28 by spring screws 40.

Figure 2:
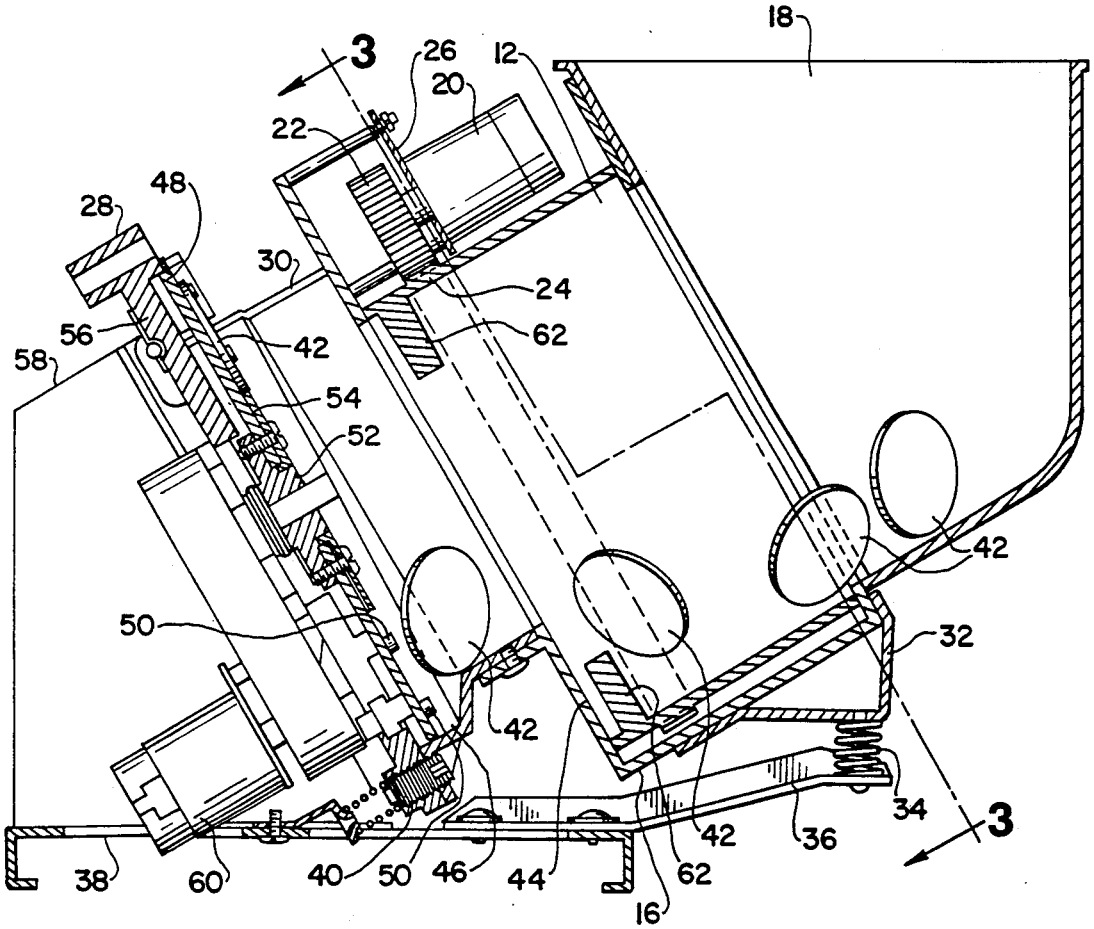
FIG. 2 is a cross section detail through the hopper of FIG. 1 showing the operation of the hopper.

With reference to FIG. 2, in operation coins 42 are fed into the coin bowl 18 and fall in response to gravity into the cylinder 12. The central axis A of the cylinder 12 is offset below the central axis B of the mount adapter 30 , which creates a shelf or wall 44. The offset dimension is not critical and not related to coin size. An offset of 2 inches has been found to be effective and allows the coin hopper 10 to fit readily into conventional gaming machine cabinets.

As coins accumulate, they pile up against the shelf 44 and eventually spill over into the mount adapter 30 and a gutter 46 where they can be picked up by the coin transport disc asembly 28. This assembly 28 includes a pinwheel 48 with coin drive pins 50 spaced around its perimeter and a coin shelf wheel 52 in its center. An agitator 54 is mounted centrally on the coin shelf wheel 52. The pinwheel 48 is rotatably mounted in a wheel housing 56 which is supported by a wheel housing mounting bracket 58. The pinwheel 48 is driven by a pinwheel drive motor 60.

The structure and operation of the pinwheel 48 are well known in the art, and will not be explained here except as is necessary to understand the invention. In coin hoppers known in the art, the coins piled up against the lower edge of the coin transport disc and tended to jam as previously explained. With the offset cylinder 12 of the invention, pressure from accumulated coins against the pinwheel 48 is alleviated by the shelf 44.

Although it is possible to provide pressure relief in a conventional coin hopper by inserting a partial barrier in front of the pinwheel, this approach does not give the increased coin capacity that the offset provides. A 7-inch diameter cylinder with a 2-inch offset will hold approximately 800 standard $5 gaming tokens or 1200 $1 tokens.

Further, with the rotating cylinder 12 of the invention, when the cylinder 12 is rotated, the lift fingers 62 pick up coins from the agglomeration against the shelf 44 and lift them above the shelf 44 so that they fall into the mount adapter 30 and the gutter 46 where they can be picked up by the pinwheel 48. The preferred speed of rotation of the cylinder 12 is approximately 20 rpm. The cylinder 12 rotates in the same direction as the pinwheel 48; otherwise, it would cause coin jams. Because rotation of the cylinder 12 is independent of the rotation of the pinwheel 48, the mixing and dispensing functions are likewise independent.

The mounting arrangement described previously allows the entire hopper assembly to move slightly with respect to the coin transport disc assembly 28, a feature which helps prevent jamming when a large quantity of coins accumulates in the hopper. The spring 34 is placed under the approximate weight center of a full coin bowl 18 This balance allows the entire coin hopper 10, i.e., the coin bowl 18/cylinder 12 assembly, to place much less pressure on the coin transport disc assembly 28. With less pressure, the coins accumulating in the gutter 46 will move the coin hopper 10 back with much less force, opening up the gutter area and allowing coin jams to be broken up by the agitator 54 more easily.

Figure 3:
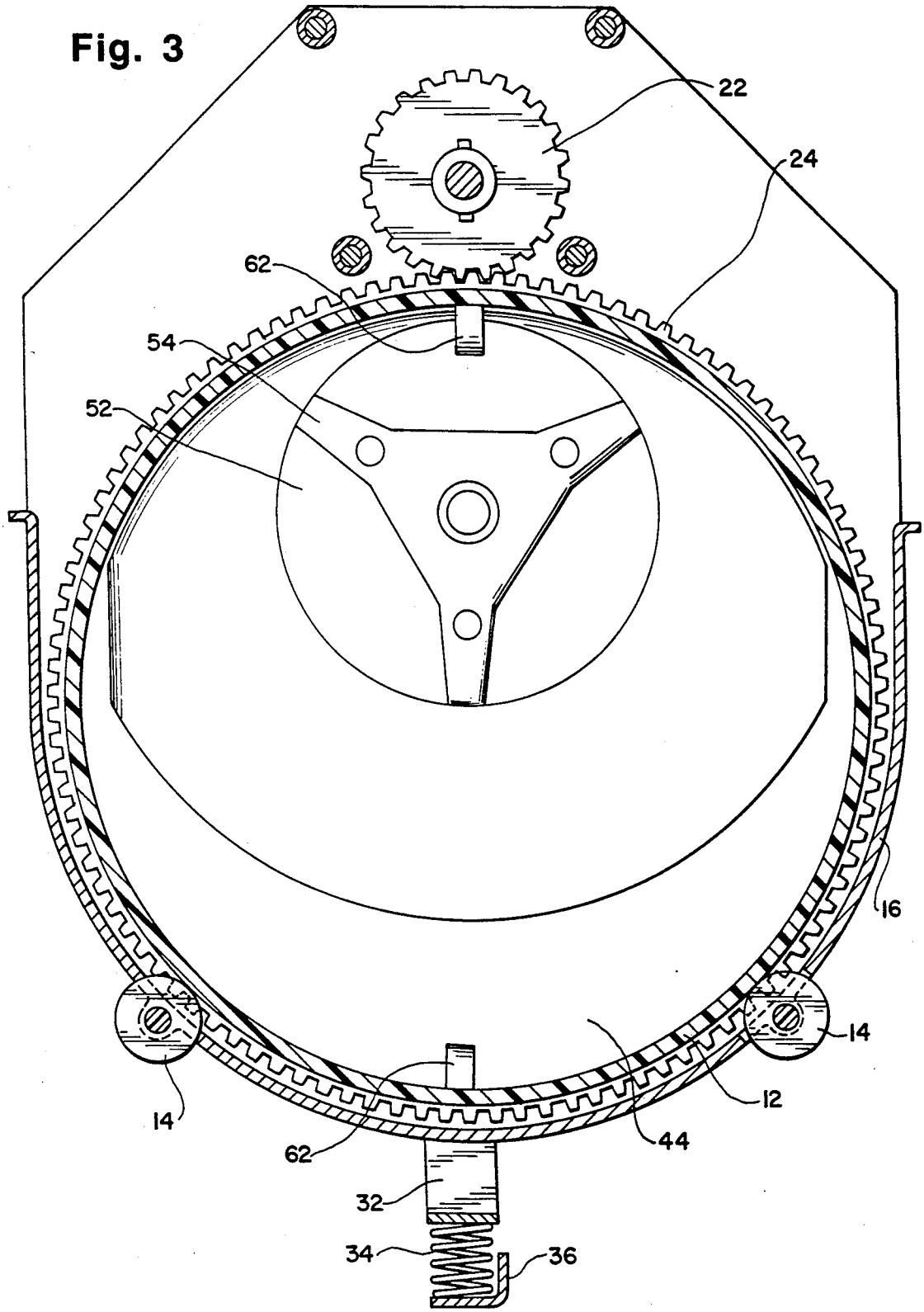
FIG. 3 is a front elevation of the hopper of FIG. 1 with the coin bowl removed.

FIG. 3 is a view through the cylinder 12 with the coin bowl 18 and cylinder drive motor 20 removed. This view clearly shows the relationship of the offset cylinder 12 vis a vis the pinwheel 48, which creates the shelf 44. The agitator 54 may also be clearly seen. The agitator 54 is made of an elastomeric material and helps to free jammed coins so that they may be picked up by the pinwheel 48. The lift fingers 62 are also clearly visible, as is the drive mechanism for the cylinder 12, which includes the cylinder drive motor 20 with gear 22 engaged with the gear teeth 24 of the exterior surface of the cylinder 12.

Figure 4:
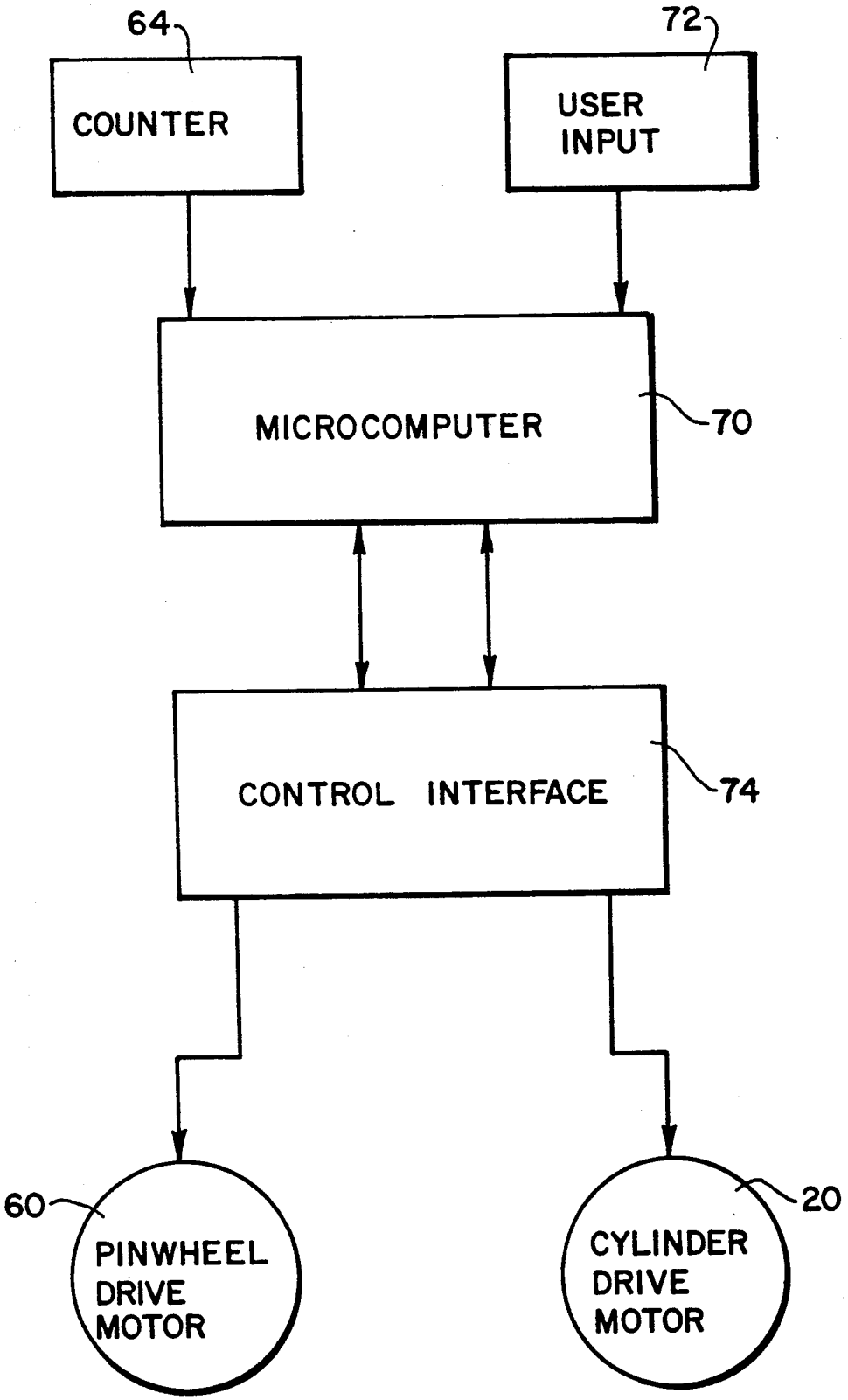
FIG. 4 is a block diagram of the control system for use with the hopper of FIG. 1.

The coin transport disc assembly 28 includes a mechanism for counting the number of coins dispensed. As shown in FIG. 1, as a coin is dispensed it pushes against a coin counter 64, which is yieldably mounted in the coin exit path. With reference to FIG. 2 and FIG. 4, the coin hopper system is under the control of a microcomputer 70 which typically controls the entire gaming device in which the hopper is employed. The microcomputer 70 accepts input from the user via a user input device 72, and is connected to the hopper motors 20,60 via a control interface 74. When the microcomputer 70 determines that a payout of coins is required, a signal from the microcomputer 70 through the control interface 74 switches the pinwheel drive motor 60 on, causing the pinwheel 48 to rotate through the gutter 46 and pick up coins 42. The counter 64 generates a signal each time a coin is dispensed. These signals are counted by the microcomputer 70, and when the proper number of coins has been dispensed, the pinwheel drive motor 60 is turned off.

The microcomputer 70 recognizes two jam conditions, a coin jam and a pinwheel jam.

If in a given time interval no coins are dispensed, i.e., the microprocessor receives no signals from the counter 64, the microcomputer 70 recognizes that a coin jam condition exists and turns on the cylinder drive motor 20. This causes the cylinder 12 to rotate and the lift fingers 62 to break up the coin jam and lift coins into the mount adapter 30 and gutter 46 where they can be picked up by the pinwheel 48.

In the preferred embodiment, if the pinwheel 48 turns for 2 seconds and no coins are counted, the pinwheel motor 60 is switched off and the cylinder drive motor 20 is turned on for 1.6 seconds. Thereafter, the cylinder drive motor 20 is turned off, and the pinwheel motor 60 is turned back on. If no coins are counted in 2 seconds, the above sequence repeats three times. If no coins are counted after the third repetition, the coin hopper 10 is shut down by the microcomputer 70. Although it would also be possible to operate the cylinder drive motor 20 continuously, it is more preferable to operate it only when necessary to clear a coin jam. Likewise, it would be possible to continue to operate the pinwheel motor 60 while the cylinder drive motor 20 is operating. However, this puts an excessive demand on the gaming machine power supply. Since it is not necessary to operate both motors simultaneously to efficiently clear a coin jam, it is preferable to turn the pinwheel motor 60 off to reduce power consumption.

If the pinwheel 48 jams and is stopped, the microcomputer 70 senses this separately as a pinwheel jam condition. The microprocessor 70 will cause the pinwheel 48 to reverse for 0.5 seconds and then attempt to rotate forward. If the pinwheel 48 will not rotate, it will reverse again for 0.5 seconds and again attempt to rotate forward. This sequence is repeated three times. If the pinwheel 48 still will not rotate forward, the coin hopper 10 will be shut down by the microcomputer 70. The cylinder drive motor 20 remains off during this entire pinwheel jam sequence.

I claim:

1. A coin storage and dispensing apparatus for a gaming machine comprising:

a frame;

an inclined hollow cylinder for holding coins rotatably mounted on said frame;

rotating means for rotating said cylinder; and rotating dispensing means for dispensing coins from said cylinder.

2. The apparatus of claim 1 wherein said cylinder has at least one lift finger mounted inside said cylinder.

3. The apparatus of claim 2 wherein said at least one lift finger is mounted inside the lower end of said cylinder.

4. The apparatus of claim 1 wherein the said rotating means comprises an electric motor.

5. The apparatus of claim 4 wherein said electric motor is operably coupled to said cylinder by a gear drive which engages a plurality of teeth located on the exterior of said cylinder.

6. The apparatus of claim 1 wherein said dispensing means comprises a rotating coin transport disc.

7. The apparatus of claim 6 wherein the central axis of said cylinder is offset from the central axis of said coin transport disc.

8. The apparatus of claim 7 wherein said central axis of said cylinder is located below said central axis of said coin transport disc.

9. The apparatus of claim 1 wherein said cylinder is movably mounted to said frame and is urged against said frame and said dispensing means by spring means.

10. The apparatus of claim 6 wherein said coin transport disc carries on its face agitating means comprising one or more projecting protruberances from said face of said disc.

11. The apparatus of claim 1 further comprising coin collection means mounted on said frame above said cylinder for collecting and directing coins into said cylinder.

12. The apparatus of claim 6 wherein the rotation of said cylinder is independent of the rotation of said coin transport disc.

13. A coin storage and dispensing apparatus for a gaming machine comprising:

an inclined hollow cylinder for holding coins;

rotating means for rotating said cylinder;

rotating dispensing means for dispensing coins from said cylinder; and detection means for detecting whether coins are being dispensed by said dispensing means.

14. The apparatus of claim 13 wherein said cylinder rotating means is operably coupled to said detection means so that said cylinder rotating means rotates said cylinder in response to a signal from said detection means indicating a coin jam.

15. The apparatus of claim 13 wherein said detection means comprises means for counting the number of coins dispensed by said dispensing means.

16. The apparatus of claim 13 wherein said dispensing means comprises a rotating coin transport disc.

17. The apparatus of claim 16 wherein the rotation of said cylinder is independent of the rotation of said coin transport disc.

18. The apparatus of claim 17 wherein said coin transport disc is not rotated while said cylinder is rotated.

19. The apparatus of claim 16 wherein the central axis of said cylinder is offset from the central axis of said coin transport disc.

20. The apparatus of claim 19 wherein said central axis of said cylinder is located below said central axis of said coin transport disc.

21. The apparatus of claim 13 wherein said cylinder has at least one lift finger mounted inside said cylinder.

22. The apparatus of claim 21 wherein said at least one lift finger is mounted inside the lower end of said cylinder.

23. The apparatus of claim 1 further comprising detection means for detecting whether coins are being dispensed by said dispensing means.

24. The apparatus of claim 23 wherein said cylinder rotating means is operably coupled to said detection means so that said cylinder rotating means rotates said cylinder in response to a signal from said detection means indicating a coin jam.

25. The apparatus of claim 24 wherein said detection means comprises means for counting the number of coins dispensed by said dispensing means.

26. The apparatus of claim 25 further comprising means for enabling said cylinder rotating means in response to a signal from said detection means indicating that no coins have been counted in a given time interval.

27. The apparatus of claim 26 further comprising means for disabling said dispensing means while said cylinder is being rotated.

* * * * *